US008692121B1

(12) United States Patent
von Detten

(10) Patent No.: US 8,692,121 B1
(45) Date of Patent: Apr. 8, 2014

(54) DEVICE FOR RECEIVING AN ELECTRICAL CONTACT

(76) Inventor: Volker von Detten, El Segundo, CA (US)

( * ) Notice: Subject to any disclaimer, the term of this patent is extended or adjusted under 35 U.S.C. 154(b) by 65 days.

(21) Appl. No.: 13/547,019

(22) Filed: Jul. 11, 2012

Related U.S. Application Data

(60) Provisional application No. 61/572,193, filed on Jul. 12, 2011.

(51) Int. Cl.
*H05K 13/04* (2006.01)

(52) U.S. Cl.
USPC ..... 174/135; 174/653; 174/655; 385/77; 248/56

(58) Field of Classification Search
USPC ..... 174/653, 135, 652, 655; 248/56; 385/77, 135
See application file for complete search history.

(56) References Cited

U.S. PATENT DOCUMENTS 7,183,486 B2 * 2/2007 Pyron et al. ..... 174/59
7,408,122 B2 * 8/2008 Heimlicher et al. ..... 174/653

* cited by examiner

*Primary Examiner* — Dhirubhai R Patel
(74) *Attorney, Agent, or Firm* — Volker von Detten

(57) ABSTRACT

This invention relates generally to a method and apparatus to engage and suspend an electrical contact of a cylindrical and elongated configuration. In accordance with the invention and described is a hollowed out, cylindrical and elongated device having two pair of spaced apart cantilever beams which extend forwardly from a base to a pin receiving end wherein the counter levered beams of each pair are opposing each other and are equally spaced along the entire circumference wherein a pin like cylindrical object engages through the hollowed out portion and urges against the cantilevered beams in a fashion to increase the distance between the opposing beams.

5 Claims, 5 Drawing Sheets

DEVICE FOR RECEIVING AN ELECTRICAL CONTACT

RELATED APPLICATIONS

This application claims the prior date of prior filed applications having Ser. No. 61/572,193 and filing date of Jul. 12, 2011 and entitled: Device for receiving an electric contact.

INCORPORATION BY REFERENCE

Applicant(s) herein incorporate by reference, any and all U.S. patents and U.S. patent applications cited or referred to in this application.

BACKGROUND OF THE INVENTION

1. Field of Invention

This invention relates to the location and suspension of an electrical contact to be presented to an apparatus such as a plating process.

2. Description of Related Art

The following art describes the present state of this field: No prior art is known to achieve the suspension of an electrical contact to a plating apparatus and specifically describing a method wherein aforesaid is held vertically, consistently and precisely throughout a plating process wherein certain portions of the contacts are presented consistently to the plating process.

SUMMARY OF INVENTION

The present invention teaches certain benefits in construction and use, which give rise to the objectives described below.

This invention relates generally to a method and apparatus to engage and suspend an electrical contact of a cylindrical and elongated configuration. In accordance with the invention and described is a hollowed out, cylindrical and elongated device having two pair of spaced apart cantilever beams which extend forwardly from a base to a pin receiving end wherein the counter levered beams of each pair are opposing each other and are equally spaced along the entire circumference wherein a pin like cylindrical object engages through the hollowed out portion and urges against the cantilevered beams in a fashion to increase the distance between the opposing beams.

A primary objective of one embodiment of the present invention is to provide an apparatus and method of use of such apparatus that yields advantages not taught by the prior art.

A still further objective is to assure that an embodiment of the invention is capable of engaging a contact in coaxial fashion along the vertical plane.

A still further objective is to assure that an embodiment of the invention is capable of engaging a contact in a secured engagement.

A still further objective is to assure that an embodiment of the invention is to assure that a contact can be disengaged from a secured engagement.

A still further objective is to assure that an embodiment of the invention is that contacts of various dimensions and configurations respectively can be engaged and secured.

Other features and advantages of the embodiments of the present invention will become apparent from the following more detailed description, taken in conjunction with the accompanying drawings, which illustrate, by the way of example, the principles of at least one of the possible embodiments of the invention.

BRIEF DESCRIPTION OF THE DRAWINGS

The accompanying drawings illustrate at least one of the best mode embodiments of the present invention. In such drawings.

The above-described drawing figures illustrate the present invention in at least one of its preferred, best mode embodiments, which are further, defined in detail in the following description. Those having ordinary skill in the art may be able to make alterations and modifications in the present invention without departing from its spirit and scope. Therefore it must be understood that the illustrated embodiments have been set forth only for the purposes of example and that they should, not be taken as limiting the invention as defined in the following.

DETAILED DESCRIPTION OF THE DRAWINGS

Figure 1:
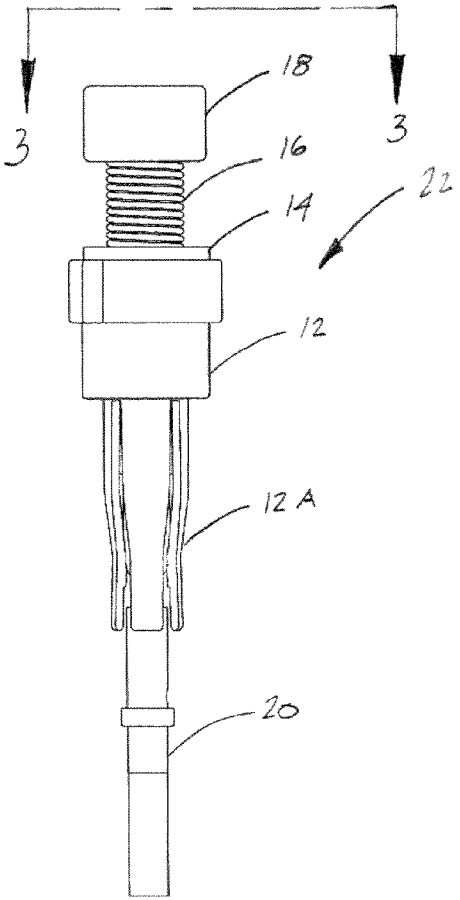
FIG. 1 is a front elevation view of a preferred embodiment of present invention showing a receiving device straddling an electric contact.

FIG. 1 is a front elevation of the present invention showing receiving device 22. The plunger 18 is in a downward position forcing canter levered beams 12 A of gripper body 12 to be spread apart from each other thus releasing contact 20. Compression spring 16 is in compressed state due to force 18A exerted upon plunger 18 pushing aforesaid downwardly and therefore expanding plurality of beams 12A. Compression spring is immediately adjacent to retainer washer 14 at the lower extremity and underside of shoulder of plunger 18 at upper extremity.

Figure 2:
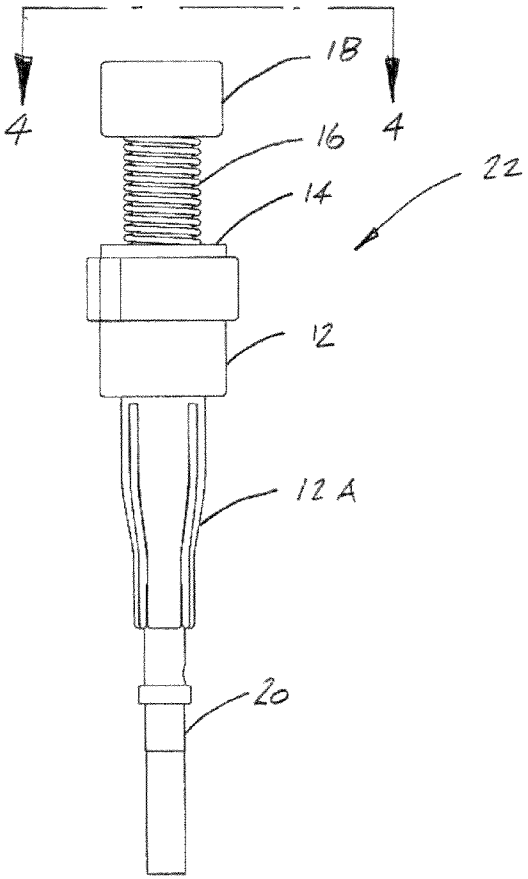
FIG. 2 is a further front elevation view of a preferred embodiment of present invention showing a receiving device engaging an electric contact.

FIG. 2 is a further front elevation of receiving device 22. Plunger 18 is in an upward position releasing canter levered beams 12A of gripper body 12 to be closed thus engaging contact 20 in a secured fashion. Compression spring 16 is in uncompressed state due to release of force 18A thus pushing aforesaid upwardly and therefore contracting plurality of beams 12A and therefore engaging and securing contact 20. Compression spring is immediately adjacent to retainer washer 14 at the lower extremity and underside of shoulder of plunger 18 at upper extremity.

Figure 3:
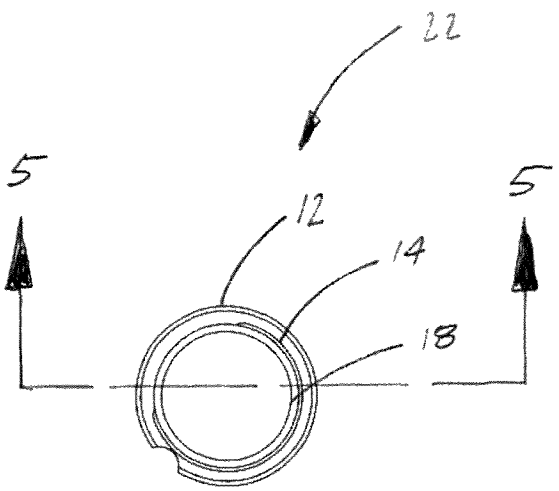
FIG. 3 is a plan view taken along lines 3-3 respectively in FIG. 1

FIG. 3 is a plan view of receiving device 22 showing subsequent components labeled.

Figure 4:
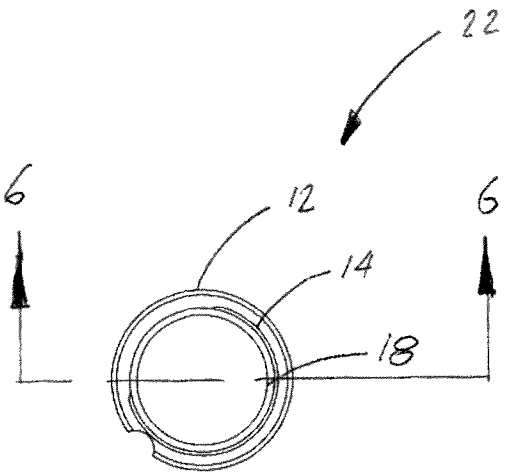
FIG. 4 is a plan view taken along lines 4-4 respectively in FIG. 2

FIG. 4 is a further plan view of receiving device 22 showing subsequent components labeled.

Figure 5:
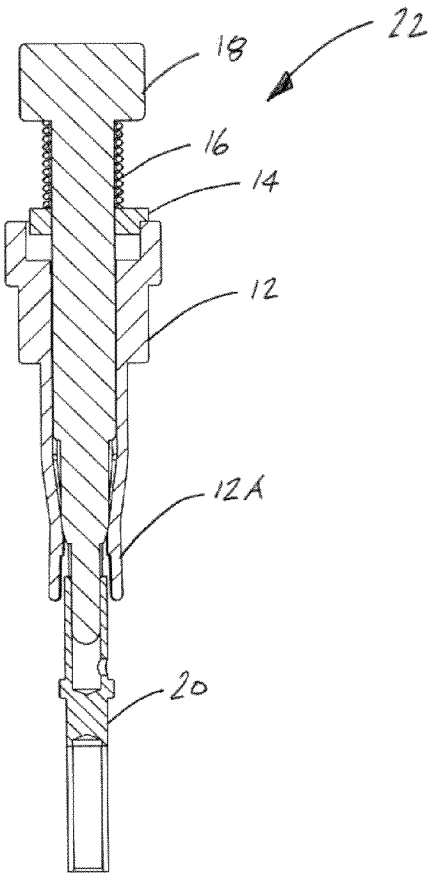
FIG. 5 is a cross sectional view taken along lines 5-5 respectively in FIG. 3.

FIG. 5 is a cross section view of receiving device 22. The plunger 18 is in a downward position forcing canter levered beams 12 A of gripper body 12 to be spread apart from each other thus releasing contact 20. Compression spring 16 is in compressed state due to force 18A exerted upon plunger 18 pushing aforesaid downwardly and therefore expanding plurality of beams 12A. Compression spring is immediately adjacent to retainer washer 14 at the lower extremity and underside of shoulder of plunger 18 at upper extremity. It is noteworthy to mention that the lower tip of plunger 18 engages with bore of contact 20 prior to releasing canter levered beams 12A thus securing proper alignment of contact 20.

Figure 6:
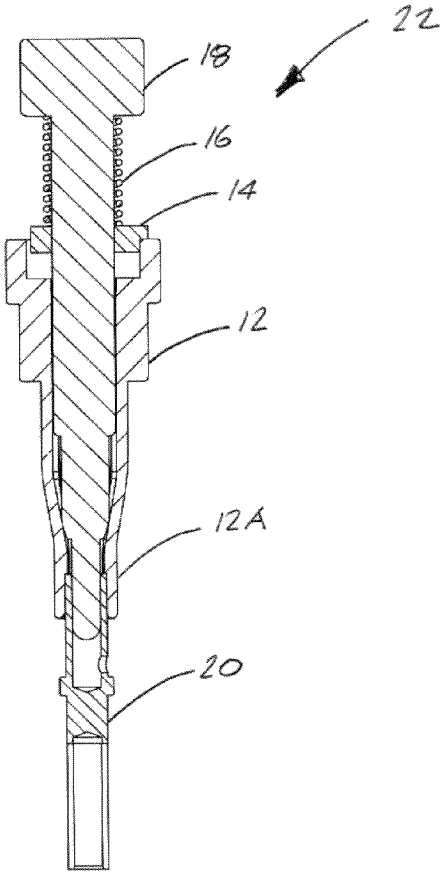
FIG. 6 is a cross sectional view taken along lines 6-6 respectively in FIG. 4.

FIG. 6 is a cross section view of receiving device 22. Plunger 18 is in a retracted position releasing canter levered beams 12A of gripper body 12 to be closed thus engaging contact 20 in a secured fashion. Compression spring 16 is in uncompressed state due to release of force 18A thus pushing aforesaid upwardly and therefore contracting plurality of beams 12A and therefore engaging and securing contact 20. Compression spring is immediately adjacent to retainer washer 14 at the lower extremity and underside of shoulder of plunger 18 at upper extremity.

Figure 7:
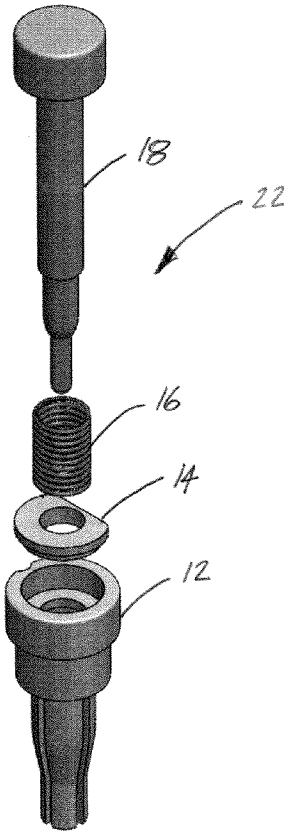
FIG. 7 is an expanded and perspective view of a preferred embodiment of present invention showing a receiving device.

FIG. 7 is a perspective and expanded view of receiving device showing subsequent components as labeled in coaxial alignment to each other.

Figure 8:
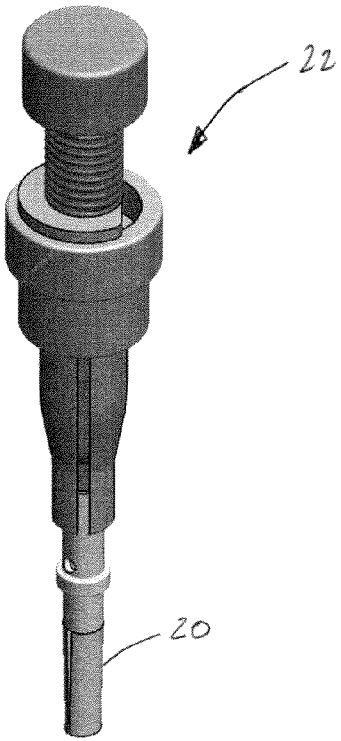
FIG. 8 is a perspective view of a preferred embodiment of present invention showing a receiving device disengaging an electric contact.

FIG. 8 is a further perspective view of receiving device 22 engaging contact 20.

Figure 9:
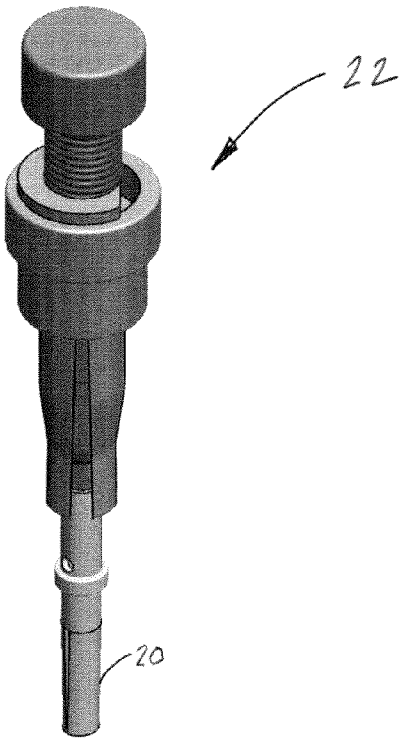
FIG. 9 is a further perspective view of a preferred embodiment of present invention showing a receiving device engaging an electric contact.

FIG. 9 is a perspective view of receiving device 22 disengaging contact 20.

The enablements described in detail above are considered novel over the prior art of record and are considered critical to the operation of at least one aspect of one best mode embodiment of the instant invention and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specifications as including more than one meaning, then its use must be understood as being generic to all possible meanings supported by the specifications and by the word or words describing the element. The definitions of the words or elements of the embodiments of the herein described invention and its related embodiments not described are, therefore, in this specifications to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the invention and its various embodiments or that a single element may be substituted for two or more elements in a claim. Changes from the claimed subject matter as viewed by a person with ordinary skill in the art, not known or later devised, are expressly contemplated as being equivalents within the scope of the invention and its various embodiments. Therefore, obvious substitutions now or later known to one with ordinary skill in the art defined to be within the scope of the defined elements. The invention and its various embodiments are thus to be understood to include what is specifically illustrated and described above, what is conceptually equivalent, what can obviously substituted, and also what essentially incorporates the essential idea of the invention. While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor believes that the claimed subject matter is the invention.

What is claimed is:

1. A receiving device for engaging and disengaging with an elongated and generally cylindrical electrical contact of a connector, comprising: a gripper body; a plunger; a retainer washer; a compression spring; the gripper body means a high contact force, elastic response range pin-receiving having at least one pair of spaced apart cantilever beams which extends forwardly from a bottom of the gripper body; the plunger means an elongated and generally cylindrical body; the retainer washer means a circumferential body having at the upper and lower extremity a horizontal surface without slope, tilt or curvature respectively; the compression spring means an elastic device exerting a resistant force upon being compressed along a vertical plane; wherein said gripper body has a coaxial through hole and a counter bore at the upper extremity, wherein said retainer washer is received by said counter bore of said gripper body.

2. The apparatus of claim 1 wherein said plunger is received by said gripper body via said through hole.

3. The apparatus of claim 1 wherein said plunger comprises the lower extremity configured as such to spread said center levered beams of said gripper body equally apart in distance upon downward movement of said plunger.

4. The apparatus of claim 1 wherein said plunger comprises at upper portion of an eyelet configuration having a step at the lower extremity.

5. The apparatus of claim 4 wherein said compression spring retracts said plunger by exerting a force upwardly against lower extremity of said step of said plunger pin.

* * * * *